US012569899B2

(12) United States Patent
Moser

(10) Patent No.: US 12,569,899 B2
(45) Date of Patent: Mar. 10, 2026

(54) DEVICE AND METHOD FOR GUIDING METAL STRIPS, COMPRISING GRINDING BODIES WITH SUPPORT ELEMENT

(71) Applicant: Primetals Technologies Austria GmbH, Linz (AT)

(72) Inventor: Friedrich Moser, Hellmonsoedt (AT)

(73) Assignee: Primetals Technologies Austria GmbH (AT)

( * ) Notice: Subject to any disclaimer, the term of this patent is extended or adjusted under 35 U.S.C. 154(b) by 894 days.

(21) Appl. No.: 17/046,809

(22) PCT Filed: Mar. 7, 2019

(86) PCT No.: PCT/EP2019/055733
§ 371 (c)(1),
(2) Date: Oct. 12, 2020

(87) PCT Pub. No.: WO2019/197085
PCT Pub. Date: Oct. 17, 2019

(65) Prior Publication Data

US 2021/0154714 A1 May 27, 2021

(30) Foreign Application Priority Data

Apr. 12, 2018 (EP) ..... 18166960

(51) Int. Cl.
*B21B 39/14* (2006.01)
*B65H 23/032* (2006.01)

(52) U.S. Cl.
CPC ..... *B21B 39/14* (2013.01); *B65H 23/0322* (2013.01); *B65H 2555/12* (2013.01); *B65H 2701/1315* (2013.01); *B65H 2701/173* (2013.01)

(58) Field of Classification Search
CPC ..... B65H 23/032; B65H 23/0322; B65H 23/0253; B65H 23/035; B65H 2555/12;
(Continued)

(56) References Cited

U.S. PATENT DOCUMENTS 2,818,954 A * 1/1958 Vice ..... B21B 39/14 119/422
5,687,603 A 11/1997 Coppenolle
(Continued)

FOREIGN PATENT DOCUMENTS

BR 112016006157 A2 8/2017
CN 102497943 A 6/2012
(Continued)

OTHER PUBLICATIONS

Japanese Office Action, dated Nov. 22, 2021, issued in Japanese Patent Application No. 2020-555496. English translation. Total 7 pages.
(Continued)

*Primary Examiner* — Anna M Momper
*Assistant Examiner* — Nathaniel L Adams
(74) *Attorney, Agent, or Firm* — OSTROLENK FABER LLP

(57) ABSTRACT

A device for laterally guiding (1) a metal strip (2) running over a metal strip conveyor device. The device has at least one main part module (3) with a guiding plane (4) and at least one grinding body with a grinding surface (5*a*, 5*b*, 5*c*) for contacting the metal strip (2) to be guided for guiding purposes. The grinding body (6) is attached to a support element (7), or the grinding body (6) includes the support element (7). The support element (7) is mounted in the main part module (3) in a movable manner in the direction of the rotational axis (10) and in a rotatable manner. The position of the grinding body in relation to the guiding plane (4) is
(Continued)

modified by moving the support element (7) prior to or while laterally guiding metal strips running over a metal strip conveyor device, prior to contacting a first metal strip for guiding purposes, and/or while contacting a first metal strip for guiding purposes.

16 Claims, 3 Drawing Sheets

(58) Field of Classification Search
CPC ..... B65H 2701/1315; B65H 2701/173; B65H 2403/46; B65H 2404/721; B21B 37/68; B21B 2273/04; B21B 39/14–18; B21B 1/22
See application file for complete search history.

(56) References Cited

U.S. PATENT DOCUMENTS

| | | | | |
|---|---|---|---|---|
| 5,904,788 | A * | 5/1999 | Kitajima | B65H 23/035 156/134 |
| 8,616,034 | B2 * | 12/2013 | Tuschhoff | B21B 37/68 72/10.4 |
| 8,616,035 | B2 | 12/2013 | Tuschhoff | 72/14.4 |
| 9,266,156 | B2 * | 2/2016 | Jepsen | B21B 39/14 |
| 10,376,938 | B2 | 8/2019 | Frauenhuber | |
| 11,779,970 | B2 * | 10/2023 | Grabner | B21B 39/14 72/250 |
| 2001/0045420 | A1 | 11/2001 | Bong | |
| 2012/0167653 | A1 | 7/2012 | Benner | |
| 2012/0174647 | A1 | 7/2012 | Benner | |
| 2014/0027496 | A1 | 1/2014 | Castillo | |
| 2016/0214154 | A1 * | 7/2016 | Frauenhuber | B65H 23/032 |
| 2021/0154714 | A1 | 5/2021 | Moser | |

FOREIGN PATENT DOCUMENTS

| | | | |
|---|---|---|---|
| CN | 102686325 | A | 9/2012 |
| CN | 102770220 | A | 11/2012 |
| CN | 103272860 | A | 9/2013 |
| CN | 105705260 | A | 6/2016 |
| CN | 106964656 | A | 7/2017 |
| CN | 210160157 | U | 3/2020 |
| DE | 1427923 | A1 | 1/1969 |
| EP | 3 409 388 | A1 | 12/2018 |
| JP | S49-81935 | U | 7/1974 |
| JP | S61-108415 | A | 5/1986 |
| JP | H11-216516 | A | 8/1999 |
| KR | 20130040291 | A | 4/2013 |
| RU | 2501616 | C1 | 12/2013 |
| RU | 2524485 | C2 | 7/2014 |
| TW | 201527007 | A | 7/2015 |
| TW | M591451 | U | 3/2020 |
| WO | WO 2011/080174 | A2 | 7/2011 |
| WO | WO 2015/043926 | A1 | 4/2015 |

OTHER PUBLICATIONS

Taiwan Office Action, mailed May 16, 2022, issued in corresponding Taiwanese Patent Application No. 108111637. English translation.

Russian Federation Office Action and Search Report, dated Oct. 8, 2021, issued in corresponding Russian Patent Application No. 2020136937/05(068107). English translation. Total 13 pages.

International Search Report mailed Apr. 12, 2019 in corresponding PCT International Application No. PCT/EP2019/055733.

Written Opinion mailed Apr. 12, 2019 in corresponding PCT International Application No. PCT/EP2019/055733.

European Search Report mailed Sep. 28, 2018 in corresponding European Patent Application No. 18166960.7.

Chinese Office Action, dated Apr. 27, 2022, issued in Chinese Patent Application No. 201910295413.X. English Search Report.

Office Action dated Dec. 5, 2023 issued in corresponding Brazilian Patent Application No. BR112020019889-7. English translation attached.

* cited by examiner

DEVICE AND METHOD FOR GUIDING METAL STRIPS, COMPRISING GRINDING BODIES WITH SUPPORT ELEMENT

CROSS-REFERENCE TO RELATED APPLICATIONS

The present application is a 35 U.S.C. §§ 371 national phase conversion of PCT/EP2019/055733, filed Mar. 7, 2019, the contents of which are incorporated herein by reference, which claims priority of European Patent Application No. 18166960.7 filed Apr. 12, 2018,the contents of which are incorporated by reference herein. The PCT International Application was published in the German language.

TECHNICAL FIELD

The application relates to a device, having wearing bodies, for laterally guiding a metal strip running over a metal strip conveying device, and to a method for this purpose.

PRIOR ART

Devices for laterally guiding a metal strip running over a metal strip conveying device are known from WO2015043926 and EP17174195.2, for example. The metal strip conveying device can be a finishing train, for example. As viewed in the direction of running of the strip, for example, this can be a region ahead of or between the roll stands or a region ahead of a coiler. In WO2015043926 and EP17174195.2, for example, a metal strip is guided laterally by wearing bodies, which are arranged in a main body module. Guidance is accomplished by contacting the metal strip to be guided with the wearing surface of a wearing body for guiding purposes. In devices of this kind for lateral guidance, it is advantageous if the wearing body repeatedly exposes fresh regions to guidance-induced wear by the metal strip to be guided by rotation about an axis of rotation.

During guidance of a metal strip by wearing bodies of this kind, a torque and a force in the direction of the guiding surface of the main body module are exerted on the wearing bodies. This causes load-induced wear and can lead to an increased requirement for replacement.

The replacement of worn wearing bodies is often performed by installing fresh wearing bodies on a wearing body shaft used for rotation about the axis of rotation. This causes a loss of time since, for each wearing body, connections between the wearing body and the associated wearing body shaft must first of all be released and then refastened after the replacement of the wearing body. Since there is a multiplicity of wearing plates in a device for lateral guidance, the overall time lost may be considerable.

SUMMARY OF THE INVENTION

Technical Problem

The problem addressed by the present invention is that of presenting a device for laterally guiding a metal strip running over a metal strip conveying device, in which the requirement for replacement is reduced, and a method for the operation thereof.

Technical Solution

This problem is solved by a device for laterally guiding a metal strip running over a metal strip conveying device, the device for laterally guiding comprising at least one main body module having a guiding plane and at least one wearing body with a wearing surface for contacting the metal strip to be guided for guiding purposes, wherein the wearing body is rotatable about an axis of rotation perpendicular to the guiding plane. There is at least one support element, wherein the wearing body is attached to the support element, or the wearing body comprises the support element, and the support element is mounted in the main body module in such a way as to be movable in the direction of the axis of rotation and in a rotatable manner.

The support element can be mounted in the main body module directly or indirectly, that is in a further component, which is arranged in the main body module.

The support element can be part of a rotary device and may be comprised, for example, the shaft of a rotary device, of round or some other cross section, and comprised of a rotary drive for rotating the wearing body.

The metal strip conveying device can be a finishing train, for example. As viewed in the direction of running of the strip, this can be a region ahead of or between the roll stands or a region ahead of a coiler.

The finishing train can be a hot strip train or some other type of rolling mill for the production of metal strip. The metal strip can be a hot-rolled metal strip. The metal strip can be a steel strip or an aluminum strip, for example.

As regards explanations relating to the main body module having a guiding plane and at least one wearing body with a wearing surface for contacting the metal strip to be guided for guiding purposes, wherein the wearing body is rotatable about an axis of rotation perpendicular to the guiding plane, attention is drawn to the disclosures of WO2015043926 and EP17174195.2, the disclosures of which are included in the present application.

The wearing body is rotatable about an axis of rotation perpendicular to the guiding plane; this axis passes, for example, through a wearing body shaft by which the force for rotation is passed from a rotary drive to the wearing body, for example. Slight deviations from a perpendicular arrangement may be included here, that is the position of the guiding plane and the axis of rotation is substantially perpendicular.

Advantageous Effects of the Invention

By means of the movable support element, the position of a wearing body in relation to the guiding plane can be modified. This can be used to extend the service life of a wearing body. A wearing body, the wearing surface of which has already worn down at the surface is advanced by the length of the worn section, for example. As long as there is wearable material on the wearing surface, this process can be repeated. Replacement of wearing bodies is therefore only necessary later than with a conventional mode of operation, in which the position of the wearing body in relation to the guiding plane cannot be modified by movement. More material can be worn off the wearing surface before replacement is necessary.

Adjustment by movement of the support element can be performed manually, mechanically and/or hydraulically, for example.

In the device for laterally guiding a metal strip running over a metal strip conveying device, there is preferably at least one adjusting device for moving the support element. It is preferably a hydraulic adjusting device. The support element can be part of the adjusting device; in the case of a hydraulic adjusting device, the cylinder piston, for example.

In the device for laterally guiding a metal strip running over a metal strip conveying device, there is preferably also a device for measuring forces exerted on the wearing body by the metal strip and/or on the metal strip by the wearing body during the lateral guidance.

Measuring the force makes it possible to determine whether movement to move the wearing surface closer to or further away from the edge of the metal strip is advantageous. Force measurement is performed via the pressure prevailing in hydraulic cylinders, for example.

There is preferably a device for controlling force exerted on the wearing body by the metal strip and/or on the metal strip by the wearing body during the lateral guidance.

The guiding force and the extent of wear can be controlled by contact.

For moving the support element, the hydraulic adjusting device preferably comprises at least one hydraulic cylinder and a device for measuring and/or controlling the cylinder travel thereof. In comparison to a purely mechanical adjusting device, which is also possible in principle, a hydraulic adjusting device is simpler to handle and, in respect of adjustment of forces exerted on the metal strip by the wearing body, offers simpler possibilities of adjustment and force- and pressure-controlled strip guidance.

If a device of this kind is added to a purely mechanical possibility of adjustment, force- and pressure-controlled strip guidance is possible in that case too.

The adjusting device is preferably supported on the main body module. In this case, forces exerted on the wearing body by the metal strip and/or on the metal strip by the wearing body are ultimately introduced into the main body module.

There is preferably an adjusting device for moving the main body module. The position of a wearing body in relation to the guiding plane can then be modified by moving the main body module.

For moving the main body module, the hydraulic adjusting device preferably comprises at least one hydraulic cylinder and optionally a device for measuring and/or controlling the cylinder travel thereof. In comparison to a purely mechanical adjusting device, which is also possible in principle, a hydraulic adjusting device is simpler to handle and, in respect of adjustment of forces exerted on the metal strip by the wearing body, offers simpler possibilities of adjustment and force- and pressure-controlled strip guidance.

The wearing body rotatable about the axis of rotation can preferably be rotated into a multiplicity of rotational positions, wherein the wearing surface is substantially parallel to the guiding plane in all the rotational positions, and the guiding plane of the main body module is substantially orthogonal to the conveying direction of the metal strip to be guided. Here, the wearing surface is the surface provided for guidance. This can be a surface before it guides and is worn. It can also be a surface which has already been worn down by previously occurring wear and is being used for guidance again. The wearing body is preferably a, preferably round, disk with a flat wearing surface.

The present application furthermore relates to a method for laterally guiding metal strips running over a metal strip conveying device, comprising at least one main body module having a guiding plane and at least one wearing body with a wearing surface for contacting the metal strip to be guided for guiding purposes, wherein the wearing body is rotatable about an axis of rotation perpendicular to the guiding plane, characterized in that the position of the wearing body in relation to the guiding plane is modified by moving a support element to which the wearing body is attached or which comprises the wearing body, before contacting a first metal strip for guiding purposes, and or during the contacting of a first metal strip for guiding purposes, and/or in a period of time after the contacting of a first metal strip for guiding purposes and before the contacting of a second metal strip for guiding purposes.

It is thereby possible to operate a device according to the invention for laterally guiding a metal strip running over a metal strip conveying device.

According to the invention, the position of the wearing body in relation to the guiding plane is modified by moving a support element to which the wearing body is attached or which comprises the wearing body. The modification of a previously existing state can take place before a first metal strip enters the guiding device—e.g. because the previously existing state was chosen for metal strips with different dimensions. The modification can also take place during the contacting of a first metal strip for guiding purposes, e.g. because knowledge is gained that makes an adjustment appear worthwhile. The modification can also take place after the contacting of a first metal strip for guiding purposes and before the contacting of a second metal strip for guiding purposes—e.g. because the first metal strip has different dimensions or it has been realized that movement closer to the edge of the metal strip is advantageous for better guidance.

The method according to the invention allows an extended time of use for wearing bodies and a reduced requirement for replacement.

The position of the wearing body in relation to the guiding plane is preferably chosen in accordance with the magnitude of the force which is exerted on the wearing body by the metal strip and/or on the metal strip by the wearing body or is expected for a further metal strip. This makes it possible to monitor the extent of wear and to ensure good guidance.

The method according to the invention allows an extended time of use for wearing bodies and a reduced requirement for replacement.

The position of the main body module in relation to the wearing surface is preferably modified by moving the main body module during the contacting of a metal strip for guiding purposes, or in a period of time after the contacting of a first metal strip for guiding purposes and before the contacting of a further metal strip for guiding purposes.

The method according to the invention allows an extended time of use for wearing bodies and a reduced requirement for replacement.

At least one wearing body is placed against the metal strip in a pressure-controlled manner by means of a hydraulic adjusting device supported on the main body module.

This makes it possible to monitor the magnitude of the guiding force while the strip is being guided and to enable monitored guidance.

BRIEF DESCRIPTION OF THE DRAWINGS

The present invention is described by way of example below with reference to a number of schematic figures.

DESCRIPTION OF THE EMBODIMENTS

Examples

Figure 1:
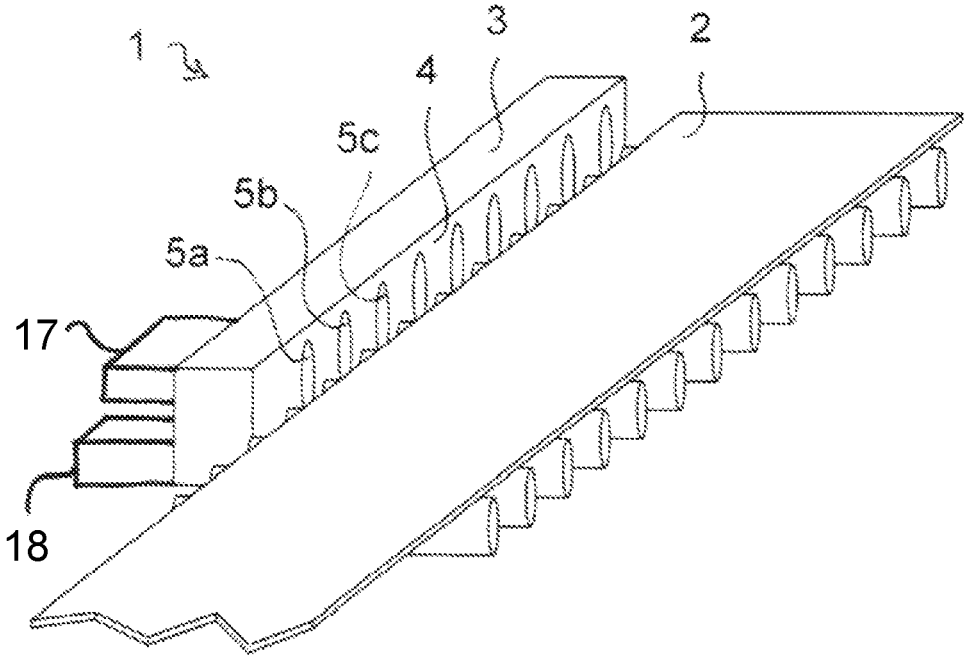
FIG. 1 shows an oblique view of a segment of a device for lateral guidance.

FIG. 1 shows a segment of a device 1 for lateral guidance schematically in an oblique view. It shows a metal strip 2 which is running over a roller conveyor.

Main body module 3 has a guiding plane 4 and a plurality of wearing bodies of which only the wearing surfaces 5*a*, 5*b*, 5*c* are illustrated. The wearing bodies are rotatable about axes of rotation perpendicular to the guiding plane. The wearing surfaces are preferably flat, as explained in WO2015043926 and EP17174195.2.

Figure 2A:
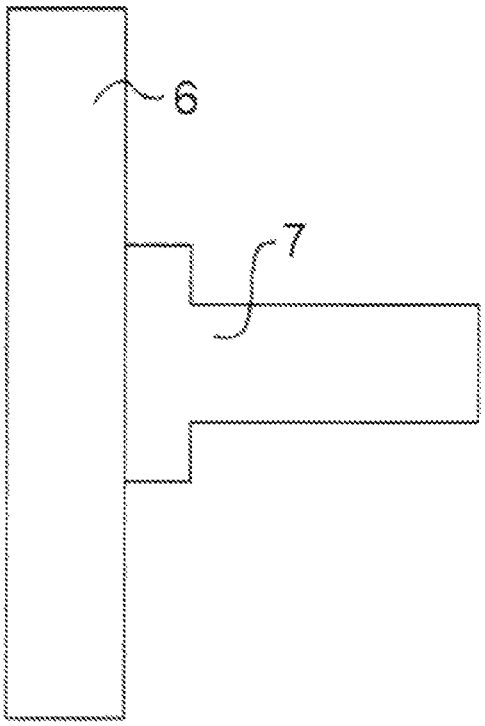
FIGS. 2*a* and 2*b* show embodiments of the wearing body and the support element.

FIG. 2*a* shows schematically a wearing body 6, to which a support element 7 is attached.

Figure 2B:
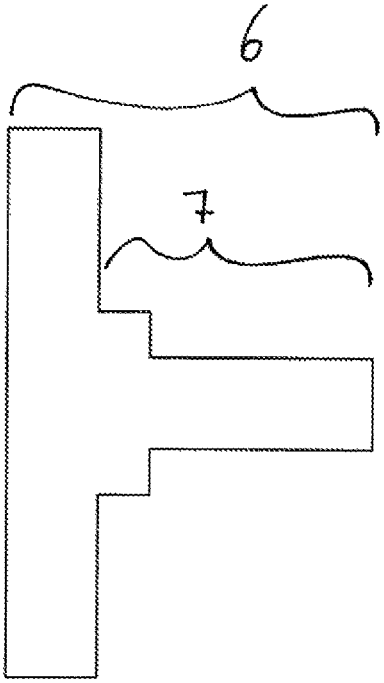

FIG. 2*b* shows schematically a wearing body 6 that comprises the support element 7 in an illustration similar to FIG. 2*a*.

Figure 3:
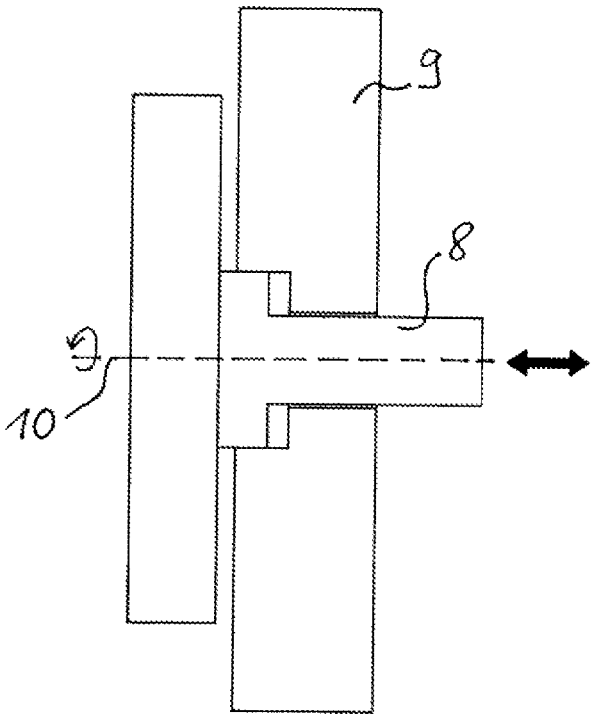
FIGS. 3 and 4 show embodiments of a movable bearing arrangement for a support element.

In an illustration similar to FIG. 2*a*, FIG. 3 shows how the support element 8 can be moved in the main body module 9 in the direction of the axis of rotation—this being indicated by a double arrow. The axis of rotation 10 about which the wearing body can be rotated passes through the support element 8. The support element 8 is rotatably mounted in the main body module.

Figure 4:
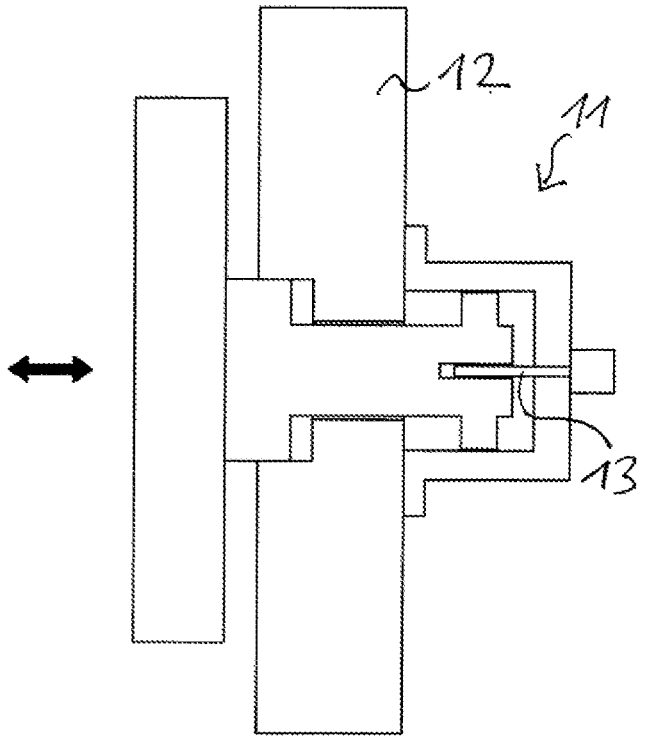

FIG. 4, which is based on FIG. 3, shows that there is a hydraulic adjusting device 11 for moving the support element. It is supported on the main body module 12. The optionally present device for measuring and/or controlling the cylinder travel 13 is likewise shown.

Optionally, a device 17 for measuring force exerted on wearing bodies and/or for measuring force exerted on the metal strip is present. Optionally, a device 18 for controlling force exerted on the wearing bodies and/or for measuring force exerted on the metal strip is present.

Optionally present devices for force- and pressure-controlled strip guidance, e.g. valve stands, have been omitted from the illustration for greater clarity.

Figure 5:
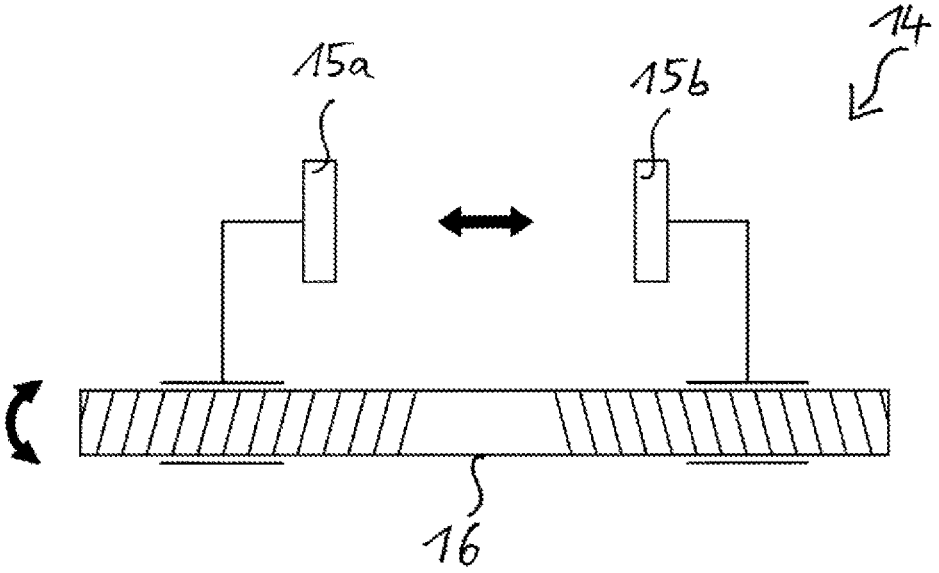
FIG. 5 shows schematically the manner of operation of a mechanical adjusting device.

FIG. 5 shows schematically a mechanical adjusting device 14 for moving the main body modules 15*a*, 15*b*. The two main body modules 15*a*, 15*b* are positioned relative to one another on opposite sides of a sheet by means of a spindle 16, which is indicated by a double arrow.

Although the invention has been illustrated and described more specifically in detail by means of the preferred illustrative embodiments, the invention is not restricted by the examples disclosed, and other variations can be derived therefrom by a person skilled in the art without exceeding the scope of protection of the invention.

LIST OF REFERENCE SIGNS

1 Device for lateral guidance
2 Metal strip
3 Main body module
4 Guiding plane
5*a*, 5*b*, 5*c* Wearing surfaces
6 Wearing body
7 Support element
8 Support element
9 Main body module
10 Axis of rotation
11 Adjusting device
12 Main body module
13 Device for measuring and/or controlling the cylinder travel
14 Adjusting device
15*a*, 15*b* Main body modules
16 Spindle

LIST OF CITATIONS

Patent Literature

WO2015043926
EP17174195.2

The incention claimed is:

1. A guiding device for laterally guiding a metal strip for running over a metal strip conveying device, the guiding device comprising:

at least one main body module having a front face, and a rear face, the at least one main body module being associated with a guiding plane;

at least one wearing body, the at least one wearing body having a respective wearing surface for contacting the metal strip which is to be guided laterally for guiding purposes and a rear surface opposite the at least one wearing surface, wherein the at least one wearing body is rotatable about a respective wearing surface axis of rotation, and the wearing surface axis of rotation is perpendicular to the guiding plane; and at least one support element attached to the at least one wearing body, and/or the at least one wearing body comprises the support element, and the support element is rotatably mounted in an opening in the main body module defined by an annular wall that supports the support element in such a way as to be movable toward and away from the guiding plane in a direction of the axis of rotation of the wearing body and to be movable in a rotatable manner, wherein the opening in the main body module extends from the front face to the rear face thereof, the opening has a mouth at the front face of the main body module, a region of the front face of the main body module extends from the mouth of the opening, the region and the mouth of the opening cover an area that is at least as wide as the rear surface of the wearing body, the at least one support element extends from the rear surface of the wearing body to a distal end thereof, the distal end passing through the main body module and extending out of the rear face of the main body module, the at least one support element is moveable to space the at least one wearing body relative to the guiding plane, and the at least one support element is rotatably and slideably mounted in the opening in the main body module with the annular wall defining the opening in the main body module in such a way as to be movable in the direction of the axis of rotation of the wearing body.

2. The guiding device as claimed in claim 1, further comprising at least one adjusting device arranged at the rear face of the main body module, and configured and operable for moving the support element.

3. The guiding device as claimed in claim 2, wherein the at least one adjusting device comprises a hydraulic adjusting device.

4. The guiding device as claimed in claim 2, further comprising a device connected to the distal end of the support element for measuring force exerted on the at least one wearing body by the metal strip and/or for measuring force exerted on the metal strip by the at least one wearing body during the lateral guiding of the metal strip.

5. The guiding device as claimed in claim 2, further comprising a device connected to the distal end of the support element for controlling force exerted on the at least one wearing body by the metal strip and/or on the metal strip by the at least one wearing body during the lateral guiding of the metal strip.

6. The guiding device as claimed in claim 3, wherein the hydraulic adjusting device comprises at least one hydraulic cylinder that is movable along the directions of the respective axis of rotation of the support element, and a device for measuring and/or controlling the cylinder travel along the directions thereof.

7. The guiding device as claimed in claim 2, wherein the at least one adjusting device is supported on the main body module.

8. The guiding device as claimed in claim 1, further comprising a main body adjusting device for moving the main body module.

9. The guiding device as claimed in claim 1, wherein the at least one wearing body is rotatable into a multiplicity of rotational positions, and the wearing surface thereof is substantially parallel to the guiding plane in all of the rotational positions; and the guiding plane of the main body module is substantially parallel to the conveying direction of the metal strip to be guided.

10. A method for laterally guiding metal strips with the guiding device of claim 1, the method comprising:

guiding the metal strips over the conveying device;

rotating the at least one wearing body at which the metal strips are conveyed about the axis of rotation of the wearing body; and modifying the position of the at least one wearing body in relation to the guiding plane by slidably moving the support element, the modifying being before the guiding of the metal strip takes place by contacting a first metal strip for guiding purposes, and/or during the contacting of a first metal strip for guiding purposes, and/or in a period of time after the contacting of a first metal strip for guiding purposes and before the contacting of a second metal strip for guiding purposes.

11. The method as claimed in claim 10, further comprising choosing the position of the at least one wearing body in relation to the guiding plane in accordance with a magnitude of force which is exerted on the at least one wearing body by the second metal strip and/or on the second metal strip by the at least one wearing body.

12. The method as claimed in claim 10, further comprising modifying the position of the main body module in relation to the at least one wearing surface by moving the main body module during the contacting of a metal strip for guiding purposes, or in a period of time after the contacting of a first metal strip for guiding purposes and before the contacting of a further metal strip for guiding purposes.

13. The method as claimed in claim 10, further comprising, for guidance, placing at least one of the at least one wearing bodies against the first metal strip in a pressure-controlled manner.

14. The method as claimed in claim 13, further comprising placing the at least one bearing body against the metal strip by operating a hydraulic adjusting device supported on the main body module.

15. A guiding device for laterally guiding a metal strip for running over a metal strip conveying device, the guiding device comprising:

at least one main body module having a front face, and a rear face, the at least one main body module being associated with a guiding plane;

at least one wearing body, the at least one wearing body having a respective wearing surface for contacting the metal strip which is to be guided laterally for guiding purposes and a rear surface opposite the at least one wearing surface, wherein the at least one wearing body is rotatable about a respective wearing surface axis of rotation, and the wearing surface axis of rotation is perpendicular to the guiding plane; and at least one support element attached to the at least one wearing body, and/or the at least one wearing body comprises the support element, and the support element is rotatably mounted in an opening in the main body module and directly supported by the main body module in such a way as to be movable toward and away from the guiding plane in a direction of the axis of rotation of the wearing body and to be movable in a rotatable manner, wherein the opening in the main body module extends from the front face to the rear face thereof, the at least one support element extends from the rear surface of the wearing body to a distal end thereof, the distal end passing through the main body module and extending out of the rear face of the main body module, the at least one support element is moveable to space the at least one wearing body relative to the guiding plane, and the at least one support element is rotatably mounted in the main body module in a bearing arrangement in such a way as to be slidably movable in the direction of the axis of rotation of the wearing body, wherein the at least one support element has a proximal end section with a proximal end at the rear surface of the at least one wearing body, and a distal end section that includes the distal end of the at least one support element, wherein the proximal end section has a cross-section that is wider than the distal end section's cross-section, wherein the opening in the main body module has a first section that extends from the front face and terminates at a second section which extends to the rear face of the main body module, and wherein the first section is wide enough to receive the proximal end section and the distal end section, and the second section is not wide enough to receive the proximal end section.

16. The guiding device as claimed in claim 15, wherein the at least one support element and the opening in the main body module are in a bearing arrangement.

* * * * *